United States Patent [19]

Golembiski

[11] Patent Number: 5,056,559

[45] Date of Patent: Oct. 15, 1991

[54] PURGE VALVE ASSEMBLY

[76] Inventor: Francis H. Golembiski, 24 W. Main St., Box 87, Elverson, Pa. 19520

[21] Appl. No.: 531,908

[22] Filed: May 31, 1990

[51] Int. Cl.[5] ..... F16K 11/076

[52] U.S. Cl. ..... 137/595; 137/607; 431/163

[58] Field of Search ..... 137/595, 597, 625.47, 137/625.19, 607; 251/31, 30.01, 59; 431/163 X

[56] References Cited

U.S. PATENT DOCUMENTS

| | | | |
|---|---|---|---|
| 3,110,228 | 11/1963 | Shramu | 251/59 X |
| 4,146,056 | 3/1979 | Buchanan | 137/597 X |
| 4,579,143 | 4/1986 | Rollins et al. | 137/597 X |
| 4,655,252 | 4/1987 | Krumhansl | 137/595 |
| 4,823,843 | 4/1989 | Golembiski | 137/605 X |

*Primary Examiner*—Stephen M. Hepperle
*Attorney, Agent, or Firm*—Leonard M. Quittner

[57] ABSTRACT

A purge valve assembly for purging the burner of a large scale power boiler of fuel oil has an air driven rotary actuator with a rotor coupled to two three-way valves such that when the actuator is in a first position, the burner is shut down, in a second position, the burner is purged of oil, and in a third position both steam and oil pass to the burner for combustion. The second or purge position is maintained by impressing air under pressure at equal pressures on both sides of the rotor.

7 Claims, 5 Drawing Sheets

PURGE VALVE ASSEMBLY

CROSS-REFERENCES

There are no cross-references to, nor are there any, related applications.

FEDERALLY-SPONSORED RIGHTS

The invention herein was made without any Federal sponsorship or contribution.

BACKGROUND OF THE INVENTION

1. The Field of the Invention

The field of the invention relates to an improved purge valve assembly useful in large scale power boilers which burn No. 6 bunker oil when such boilers are to be shut down.

2. Description of the Prior Art

Large scale power boilers which operate by burning No. 6 (Bunker) oil require hot purging of the fuel upon shut down. Failure to do so will cause the fuel to become viscous or carbonized as it cools thereby causing the burner and adjacent feeds to become clogged U.S. Pat. No. 4,823,843 (Apr. 25, 1989 to Golembiski) discloses a valve apparatus based upon a lost motion coupler to actuate steam and fuel valves to give either steam and fuel concurrently to facilitate atomization and burn, recirculate fuel or provide a steam purge. These are the basic requirements of boiler systems of the type. U.S. Pat. No. 4,146,056 (Mar. 27, 1979 to Buchanan) discloses a purge valve with linear actuation. Combustion Engineering, Inc. has a purge valve network which performs the operations essentially in the manual mode.

Each of the foregoing has limitations caused by the harsh environment of high pressure steam and liquified No. 6 oil. For example, failure in the field of parts from thermal stresses, the passage through them of steam at 550 degrees Fahrenheit at 300 psi and the like is a common occurrence. Under the circumstances, maintenance can be difficult and complex.

SUMMARY OF THE INVENTION

Objects of the present invention are to provide a simplified purge cycle to an oil burning power boiler and to do so with components which are easily maintained or replaced in the field.

Accordingly, to accomplish the foregoing, the present invention is summarized as an apparatus to provide a purge cycle through a simplified two three-way-valve arrangement coupled to an air driven rotary actuator. Purge is accomplished by applying a pressure balance to the rotary actuator through both ports which enables steam to pass simultaneously through the fuel feeds to the burner tip while still maintaining steam at the steam infeed of the burner thereby preventing any undesirable counterflow within the structure and permitting an efficient purging of the apparatus of fuel oil prior to shut down.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 9 figures are shown on 5 sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 4B:
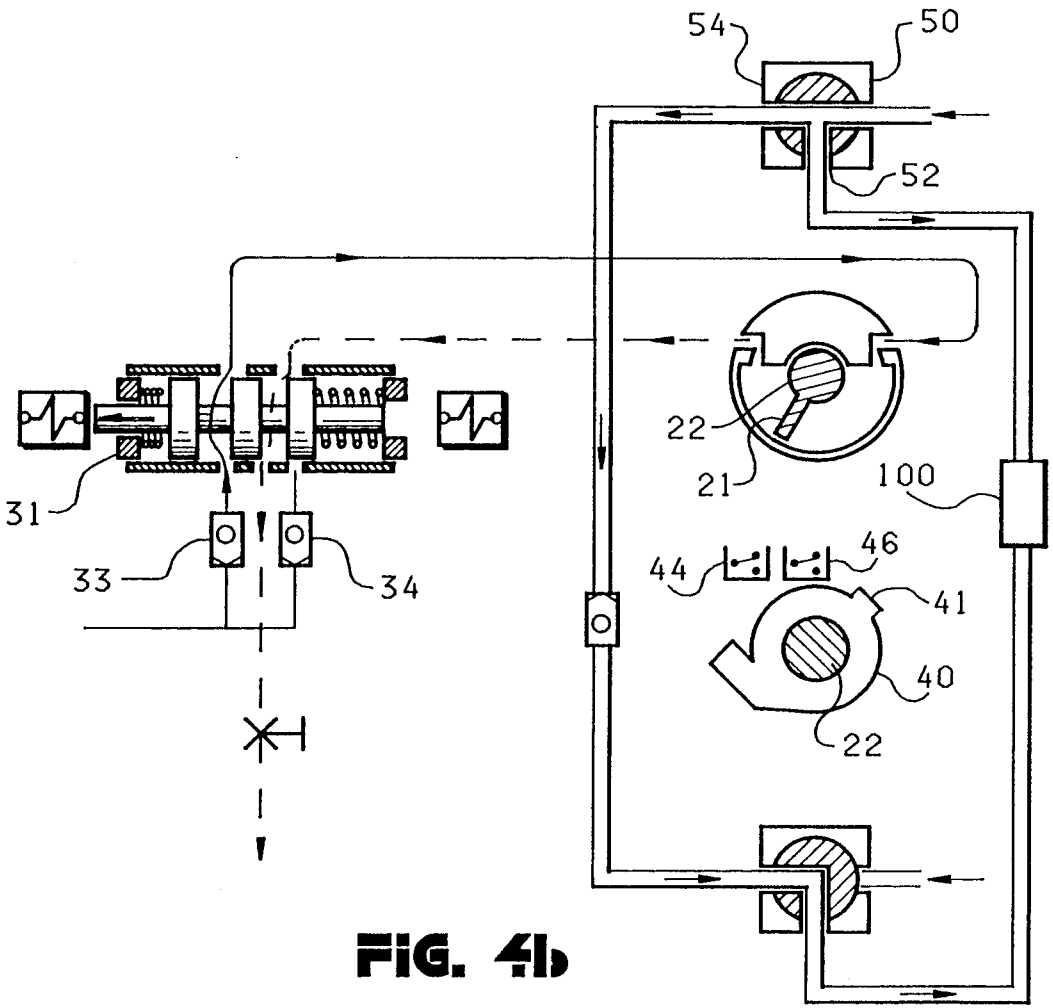
Figure 4A:
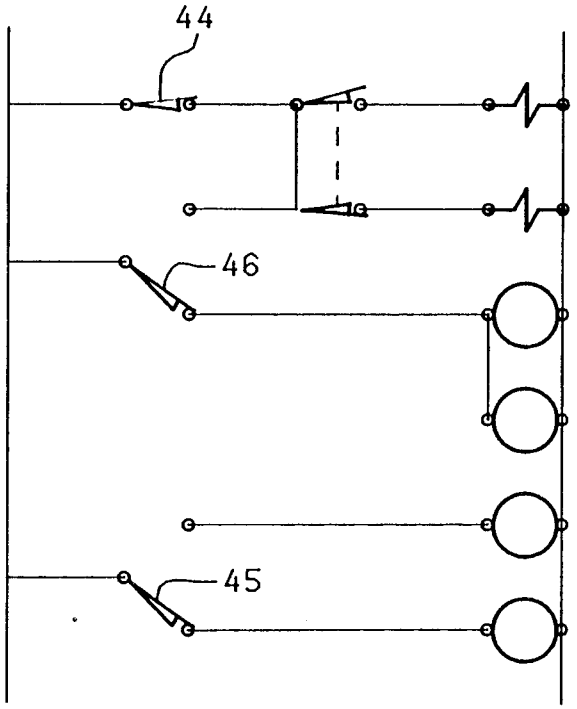
Figure 5B:
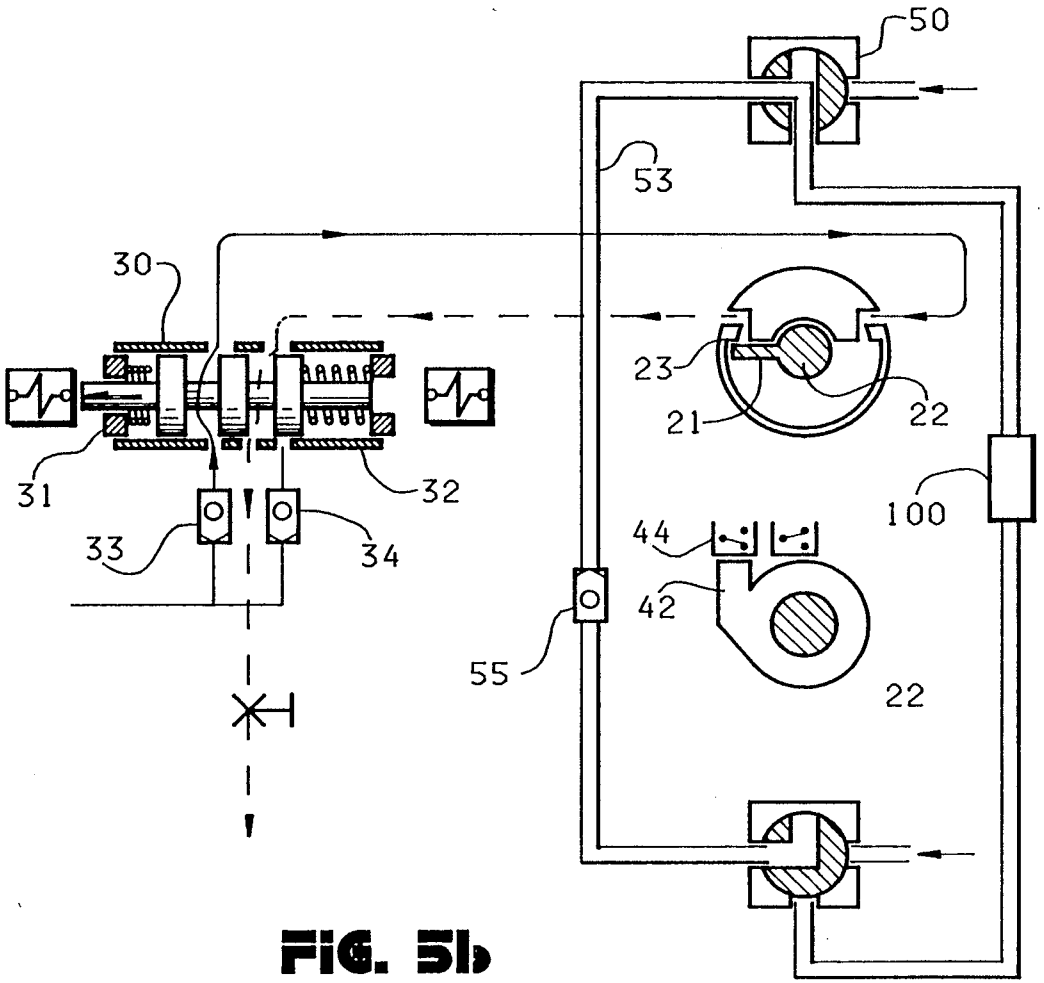
Figure 5A:
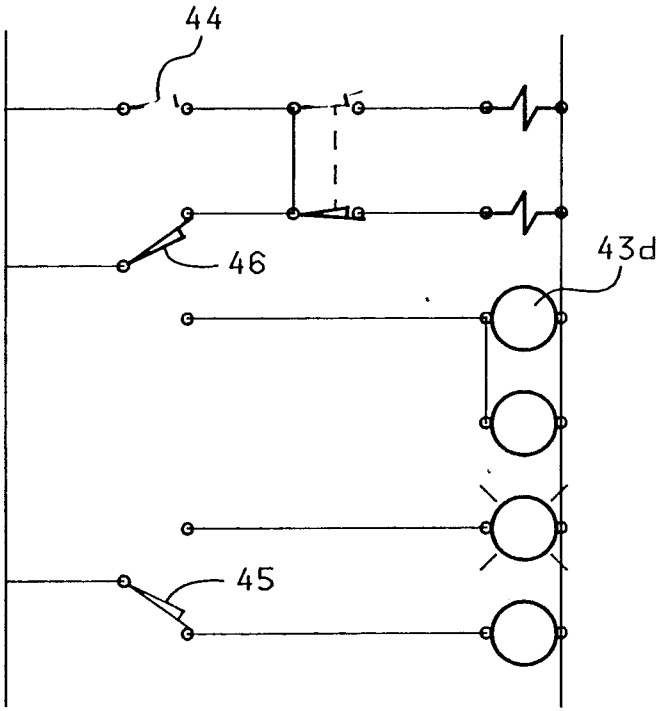

The preferred embodiment is described as comprising a valve assembly 10 for purging fuel from certain feedlines and a burner having a burner tip (not shown) and an atomizing zone (not shown) in a large scale power boiler comprising a pneumatically driven rotary actuation cylinder 20 with a rotor gate 21 attached to a through shaft 22 having a first or zero degree position against a mechanical stop 23 (See FIG. 5B) and a second or 180 degree position against a mechanical stop 24 (See FIG. **2*b*). The shaft 22 has exposed first 25 and second 26 ends, the actuator's rotary motion being controlled by a solenoid operated pilot 30 with coils 30*a*, 30*b* and first 31 and second 32 three-way air valves in operative connection with each other such that when one valve is open the other is closed and vice versa (See FIGS. 2*a,b* and 4*a,b*) to allow for the passage of pressurized air, a switch activator 40 mounted at typically the second shaft end 26 such that the shaft's rotary motion will activate first 44 and 46 second proximity switches disposed adjacent thereto and indicator lamps 43*a,b,c,d* associated with said switches. Assembled couplingly to the first shaft end is a first 50 three port rotary ball valve in a "T" configuration rated to serve steam at 550 degrees Fahrenheit at 350 psi such that when the rotor 21 is in the 180 degree position (See FIG. 2*b*) steam 51 will pass by means of a feedline 52 to the atomizing zone (not shown) in the burner 100, no steam will pass therethrough when the actuator is in the zero degree position (See FIG. 5*b*) and steam will pass through line 51 to both the atomizing zone and through a bypass line 53 and a check valve 55 to a second 60 or fuel valve described below for distribution to the burner when the rotor 21 is held in a midway or 90 degree position (See FIG. 3*b*) between the mechanical stops. The switch 44, 46 positions, as rotor 22 rotates, shift from those shown in FIGS. 3*a* and 3*b* to those shown in FIGS. 5*a* and 5*b*, are depicted in FIGS. 4*a* and 4*b* wherein switch 44 is momentarily closed and 46** remains closed.

Assembled couplingly to the second shaft end 26 is the second 60 or fuel valve which is of the three port rotary type with an "L" ball configuration rated to serve fuel at 200 degrees F. at 250 psi such that when the actuator is in the 180 degree position (See FIG. **2*a*) fuel is passed to the burner tip through port 61, no fuel will pass in the zero degree position (See FIG. 5*b*) and in the intermediate or 90 degree position (See FIG. 3*b*) steam from the first valve via port 54 and line 53 will pass to the burner tip through port 62**.

To facilitate the foregoing the switch activator 40 is made of a magnetic material and is in the shape of an annulus with a first 41 boss disposed on its outer perimeter. Diametrically opposed to the first boss on the outer perimeter is a second boss 42 which protrudes at a right angle to a line 48 passing through the first boss and the center of the annulus and is mounted such that when the actuator is in the 180 degree position (See FIG. **2*b***)

neither boss influences the proximity switches 44, 46, in the 90 degree position the first boss influences the second proximity switch 46 and in the zero position the second boss 42 influences the first proximity switch 44.

Figure 1:
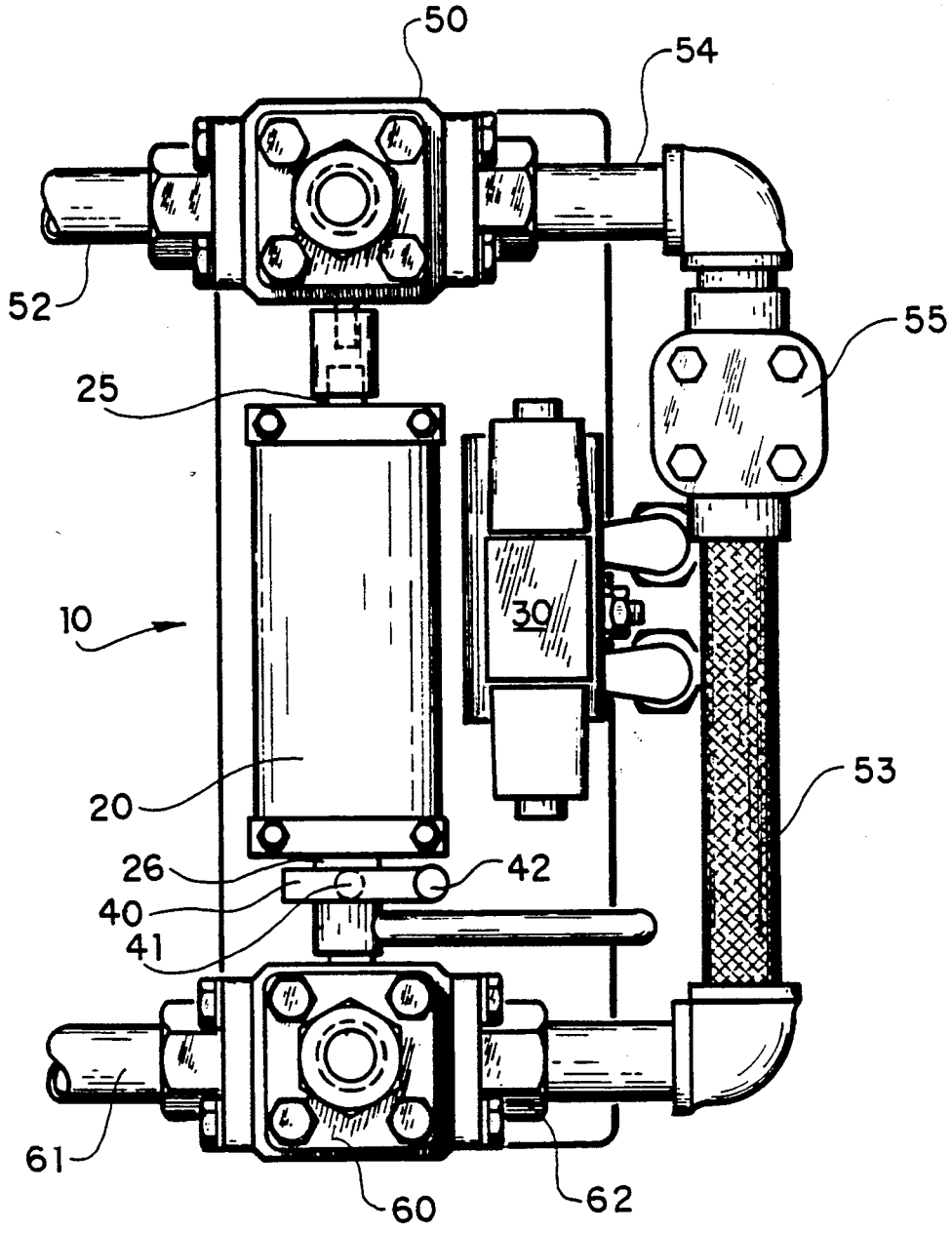
FIG. 1 shows an assembly elevation view of the apparatus of the invention.
Figure 2B:
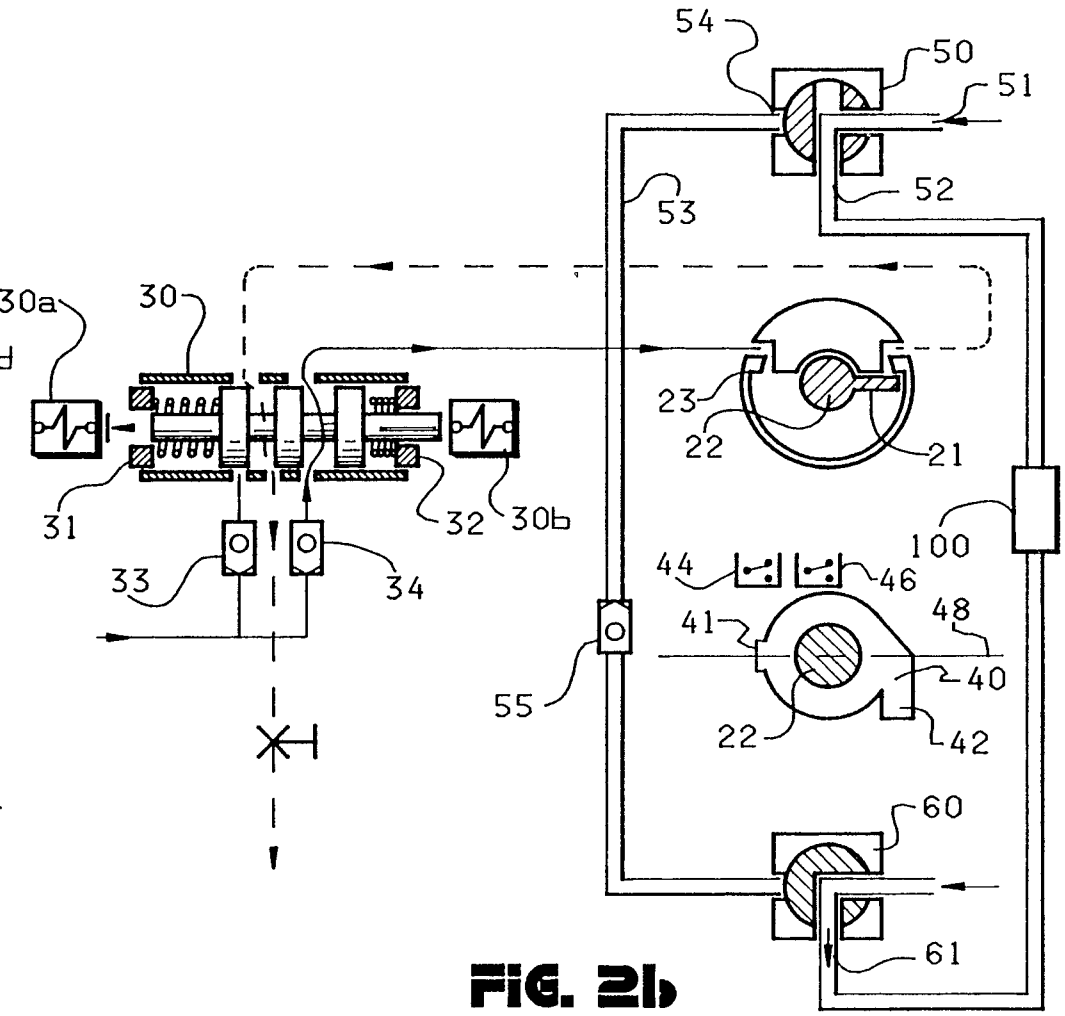
FIGS. 2A, B through 4 show progressive alignments of the principal parts of the invention in cooperation with each other at various stages in the operative cycle.
Figure 2A:
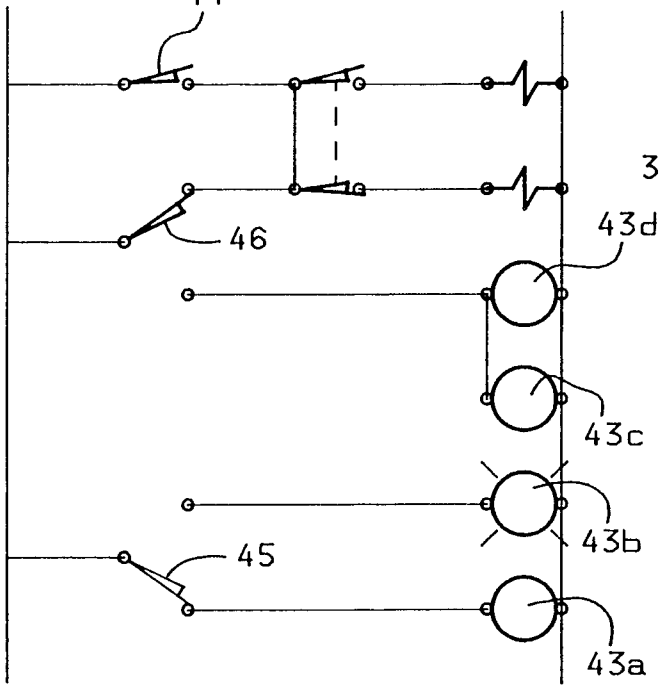

Attention is directed to FIGS. 2*a*, 2*b* which schematically represents the position of each component of the invention during the burn phase. The rotor gate 21, by virtue of pressurized air, typically at 80 psi is found at the 180 degree position which allows the first valve to pass steam to the burner atomizing zone. The switch activator influences neither proximity switch and fuel is fed to the burner tip.

Figure 3B:
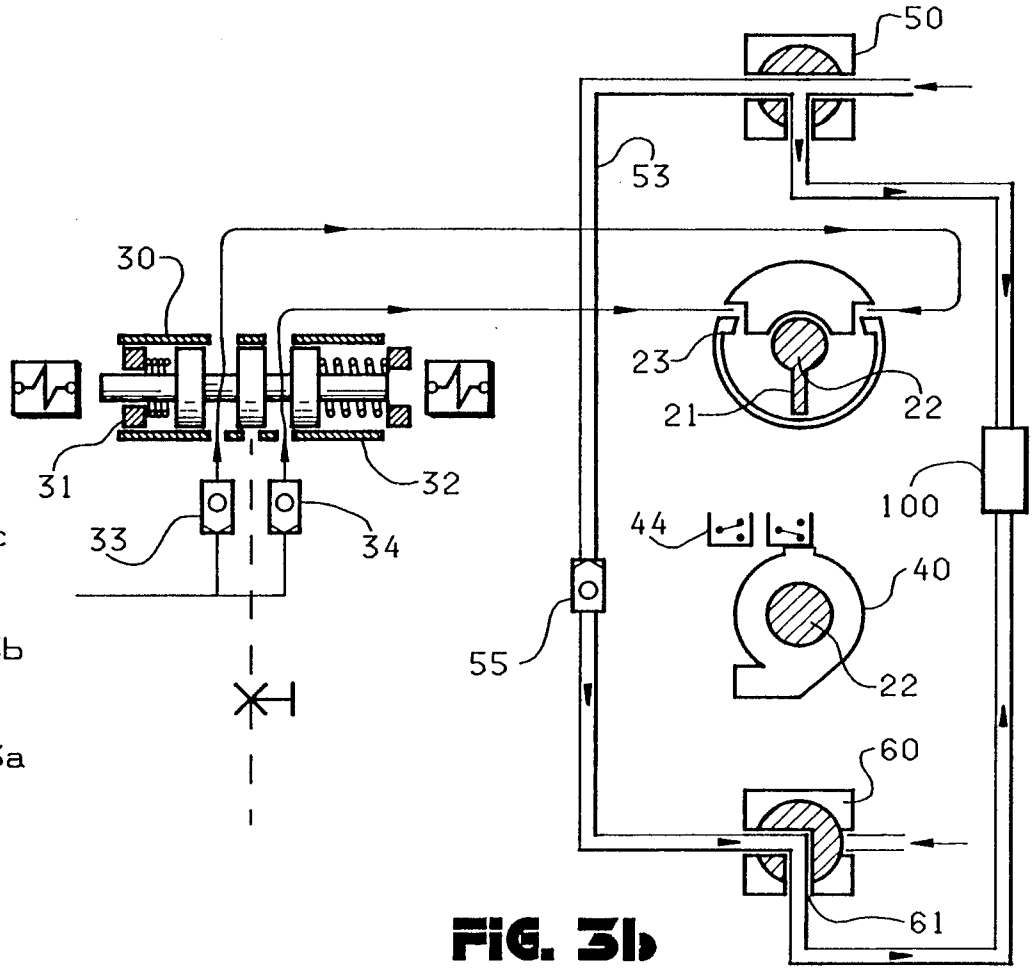
Figure 3A:
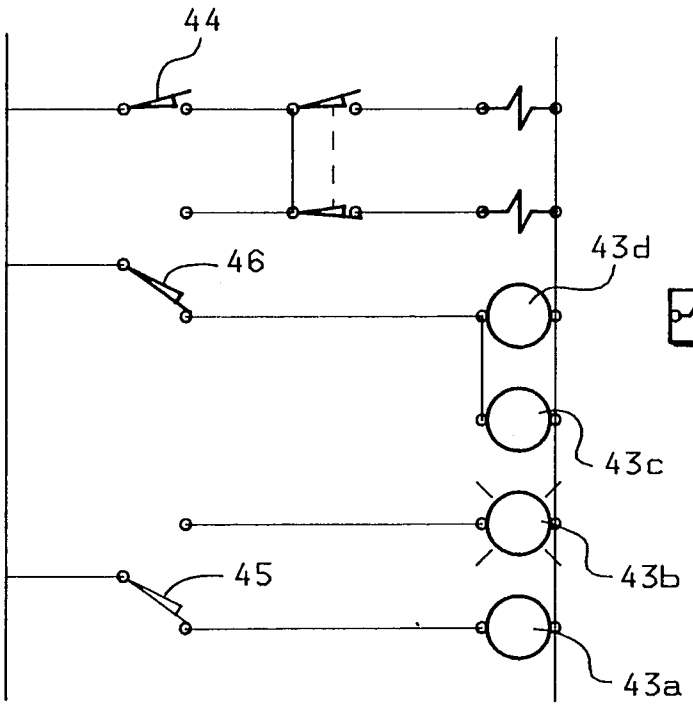

In FIGS. 3*a*, 3*b* the purge phase is represented. A feature of the present invention is that the 90 degree mode is in effect a pneumatic stop and is enabled by permitting passage of air through both air valves 31, 32 simultaneously in combination with check valves 33, 34. Accordingly, if rotor gate 22 moves toward the 0 degree or 180 degree position, because of the check valve, line pressure on the side in the direction of the movement will tend to increase, thereby resisting the movement and restoring the 90 degree position during purge. The air will cause the rotor to come to rest intermediately between the mechanical stops at approximately the 90 degree position. The first valve passes steam to the atomizing zone and steam into the second valve which has been rotated to permit passage of steam to the burner tip. The activator now influences the second proximity switch by means of the first boss which has been rotated to influence it. Switch 44 is time-delayed and maintains the purge cycle automatically for a period of time defined by the boiler operator.

In FIG. 5*b*, both steam and fuel valves are closed, the burner is shut down with the feeds and burner purged of oil. The switch activator has been rotated such that the second boss influences the first proximity switch to indicate by no lights on the down condition of the burner. Switch 45 is optionally installed to show the status of the valves 50 and 60 through lamps 43*a*, 43*b* as open or closed.

Since many modifications, variations and changes in detail may be made to the presently described embodiment, it is intended that all matters in the foregoing description and accompanying drawings be interpreted as illustrative and not by way of limitation.

What is claimed is:

1. A purge valve assembly for purging a burner in a pressure boiler comprising a single fluid driven rotary actuating cylinder having a rotor which rotates on a shaft from a mechanical stop at first or zero degrees position through a pneumatic stop at second or 90 degrees position to a mechanical stop at third or 180 degrees position, the shaft having upper and lower ends which extend exteriorly through the cylinder's housing, the upper end being coupled to a first three-way valve for controlling the flow of steam and the lower end coupled to a second three-way valve for controlling the flow of fuel, the first and second valves being coupled to the rotor shaft such that when the rotor is in the third or 180 degrees position steam and fuel shall pass through both valves to the burner, when the rotor is in the second or 90 degree position steam only shall pass to the burner and when the rotor is in the first or zero degrees position neither steam nor fuel shall pass to the burner.

2. A purge valve assembly as in claim 1 wherein the pneumatic stop means at the second position is air under pressure at equal pressures on both sides of the rotor.

3. A purge valve assembly as in claim 1 wherein the first three-way valve is a ball valve in a "T" configuration.

4. A purge valve assembly as in claim 1 wherein the second three-way valve is a ball valve in an "L" configuration.

5. A purge valve assembly for purging a burner comprising a fluid driven rotary actuating cylinder having:

(a) a rotor which rotates on a shaft from a mechanical stop at first or zero degrees position through a pneumatic stop at second or 90 degrees position,
  (i) the pneumatic step being caused by air pressure on both sides of the rotor being equal, (b) to a mechanical stop at third or 180 degrees position, (c) the shaft extending exteriorly through the cylinder's housing having upper and lower ends,
  (i) the upper end being coupled to a first three-way valve for controlling the flow of stem and
  (ii) the lower end coupled to a second three-way valve for controlling the flow of fuel, (d) the first and second valves being coupled to the rotor shaft such that when the rotor is in the third or 180 degrees position, steam and fuel shall pass through both valves, when the rotor is in the second or 90 degree position, steam only shall pass through the burner and when the rotor is in the first or zero degrees position, neither steam or nor fuel shall pass to the burner.

6. A purge valve assembly as in claim 5 wherein the first three-way valve is a ball valve in a "T" configuration.

7. A purge valve assembly as in claim 5 wherein the second three-way valve is a ball valve in an "L" configuration.

* * * * *

US005056559A

REEXAMINATION CERTIFICATE (1917th)

United States Patent [19]

Golembiski

[11] B1 5,056,559

[45] Certificate Issued Jan. 26, 1993

[54] PURGE VALVE ASSEMBLY

[76] Inventor: Francis H. Golembiski, 24 W. Main St., Box 87, Elverson, Pa. 19520

Reexamination Reqs:st:
No. 91/002,739, Jun. 1, 1992
No. 91/002,747, Jun. 8, 1992

Reexamination Certificate for:

| | |
|---|---|
| Patent No.: | **5,056,559** |
| Issued: | **Apr. 25, 1989** |
| Appl. No.: | **531,908** |
| Filed: | **May 31, 1990** |

[51] Int. Cl.[5] ..... F16K 11/076
[52] U.S. Cl. ..... 137/595; 137/607; 431/163
[58] Field of Search ..... 137/595, 597, 607, 625.19, 137/625.47; 251/30.01, 31, 59; 431/163

[56] References Cited

U.S. PATENT DOCUMENTS

| | | | |
|---|---|---|---|
| 3,110,228 | 11/1963 | Shramo et al. | 251/59 X |
| 4,146,056 | 3/1979 | Buchanan | 137/597 X |
| 4,579,143 | 4/1986 | Rollins et al. | 137/597 X |
| 4,655,252 | 4/1987 | Krumhansl | 137/595 |
| 4,823,843 | 4/1989 | Golembiski | 137/637.1 |

OTHER PUBLICATIONS

Numantics, Inc. Literature, Mark 8 Line, Nov. 1987.
Turn-Act, Inc. Literature, Rotary Vane Actuators Turn-Act, Oct. 1987.

*Primary Examiner*—Stephen M. Hepperle

[57] ABSTRACT

A purge valve assembly for purging the burner of a large scale power boiler of fuel oil has an air driven rotary actuator with a rotor coupled to two three-way valves such that when the actuator is in a first position, the burner is shut down, in a second position, the burner is purged of oil, and in a third position both steam and oil pass to the burner for combustion. The second or purge position is maintained by impressing air under pressure at equal pressures on both sides of the rotor.

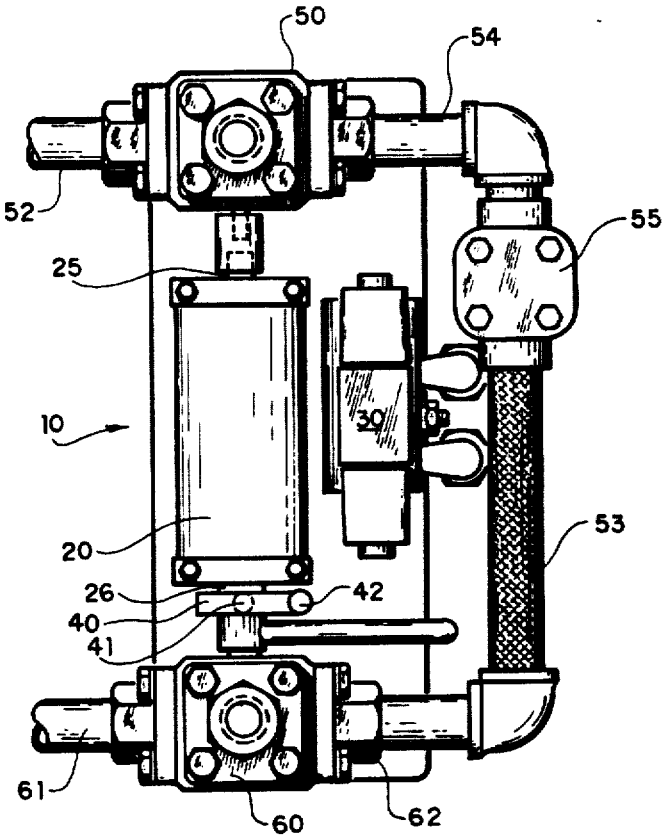

US005056686A

REEXAMINATION CERTIFICATE (1922nd)

United States Patent [19]

[11] B1 5,056,686

Jarrett

[45] Certificate Issued Feb. 2, 1993

[54] BEVERAGE DISPENSING SYSTEM

[75] Inventor: Charles C. Jarrett, Bellevue, Wash.

[73] Assignee: Nutri-Fruit, Inc., Bellevue, Wash.

Reexamination Request:
No. 90/002,694, Apr. 3, 1992

Reexamination Certificate for:

| | |
|---|---|
| Patent No.: | 5,056,686 |
| Issued: | Oct. 15, 1991 |
| Appl. No.: | 530,116 |
| Filed: | May 29, 1990 |

Related U.S. Application Data

[63] Continuation-in-part of Ser. No. 372,837, Jun. 27, 1989, abandoned.

[51] Int. Cl.[5] ..... B67D 5/56

[52] U.S. Cl. ..... 222/129.2; 222/325; 222/144.5

[58] Field of Search ..... 222/129.1-129.4, 222/132, 135, 144.5, 148, 189, 249, 255, 325, 608, 626

[56] References Cited

U.S. PATENT DOCUMENTS

| | | | |
|---|---|---|---|
| 3,735,898 | 5/1973 | Smith | 222/129.4 |
| 4,181,242 | 1/1980 | Zygiel et al. | 222/1 |
| 4,282,987 | 8/1981 | Thomas et al. | 222/70 |
| 4,323,004 | 4/1982 | Sereda et al. | 99/275 |
| 4,333,587 | 6/1982 | Fessler et al. | 222/129.1 |
| 4,708,266 | 11/1987 | Rudick | 222/105 |
| 5,000,352 | 3/1991 | Cleland | 222/129.2 |

OTHER PUBLICATIONS

SHURflo, "*Brix Proportion Pump Phase II Installation,*" *revision B, Aug., 1987, p. 6.*

SHURflo, product brochure "*Brix Pump,*" 1986 or 1987, p. 2.

SHURflo, product brochure, "*There's more than one way . . .* ", 1986? or 1987?, p. 1.

SHURflo, "*Brix Proportioning Pump General Application Guidelines,*" 1986? or 1987?, p. 5.

Multiplex, "*Multiplex Beverage Equipment Installation Instructions,*" Aug., 1988, p. 6.

Automatic Bar Controls brochure, "*Liquor Control Systems of Tomorrow Will Provide For . . .* ", 1980?, p. 1.

Electronic Dispensers International brochure and distributor price schedule, "*Electron-O-Mix/Mix-E-Lector,*" Apr., 1967, p. 1.

Electronic Dispensers International product brochure, "*Redi-Bar,*" pre-1980, p. 4.

Automatic Bar Control brochure, "*Portable Bar System,*" date unknown, p. 2.

*Primary Examiner*—Gregory L. Huson

[57] ABSTRACT

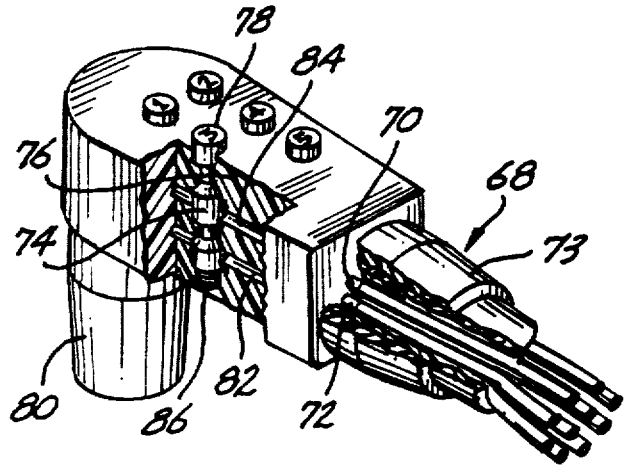

A beverage dispensing system for providing a number of different flavored drinks mixed from concentrate and fluid. The system has a number of containers for storing different flavors of concentrate and a piping system including a coupling adapted to receive pressurized fluid, such as water, from an external source. Each container is in fluid communication with a specific fluid-driven proportion pump that is also in fluid communication with the piping system. Separate concentrate and fluid supply lines extend from each pump to a dispensing head. Valves in the dispensing head control the discharge of fluid therefrom so that when a selected beverage is desired, the appropriate concentrate and fluid from the associated fluid supply line are discharged simultaneously to ensure that the end beverage contains the appropriate mixture of concentrate and fluid so as to be of acceptable quality.